US006901896B2

(12) United States Patent
Yamamoto et al.

(10) Patent No.: US 6,901,896 B2
(45) Date of Patent: Jun. 7, 2005

(54) ARM TYPE VALVE GEAR

(75) Inventors: Ken Yamamoto, Shizuoka (JP); Eiji Maeno, Shizuoka (JP)

(73) Assignee: NTN Corporation, Osaka (JP)

( * ) Notice: Subject to any disclaimer, the term of this patent is extended or adjusted under 35 U.S.C. 154(b) by 33 days.

(21) Appl. No.: 10/849,021

(22) Filed: May 20, 2004

(65) Prior Publication Data

US 2004/0231621 A1 Nov. 25, 2004

(30) Foreign Application Priority Data

May 22, 2003 (JP) ..... 2003-144518

(51) Int. Cl.[7] ..... F01L 1/18
(52) U.S. Cl. ..... 123/90.45; 123/90.43; 123/90.52; 123/90.53; 123/90.54; 411/180
(58) Field of Search ..... 123/90.39, 90.43–90.45, 123/90.47, 90.48, 90.52–90.54; 411/180

(56) References Cited

U.S. PATENT DOCUMENTS

| | | | | |
|---|---|---|---|---|
| 4,548,168 A | * | 10/1985 | Gill | 123/90.54 |
| 4,706,620 A | * | 11/1987 | Gill | 123/90.54 |
| 4,981,117 A | * | 1/1991 | McRobert et al. | 123/90.43 |
| 5,881,691 A | | 3/1999 | Schmidt et al. | |
| 6,032,630 A | * | 3/2000 | Yamamoto et al. | 123/90.54 |
| 6,109,228 A | * | 8/2000 | Yamamoto et al. | 123/90.54 |
| 6,729,288 B2 | * | 5/2004 | Yamamoto et al. | 123/90.54 |
| 2003/0075131 A1 | * | 4/2003 | Gill | 123/90.45 |
| 2004/0154572 A1 | * | 8/2004 | Yasuda et al. | 123/90.52 |

FOREIGN PATENT DOCUMENTS

| | | |
|---|---|---|
| GB | 2 033 472 | 5/1980 |
| JP | 5-21602 | 6/1993 |
| JP | 10-231711 | 9/1998 |
| WO | 90/10787 | 9/1990 |

* cited by examiner

*Primary Examiner*—Thomas Denion
*Assistant Examiner*—Kyle M. Riddle
(74) *Attorney, Agent, or Firm*—Wenderoth, Lind & Ponack, L.L.P.

(57) ABSTRACT

For an arm type valve gear in which a lash adjuster is mounted between an arm pivoted by the rotation of a cam and a valve stem, it is a goal to reduce the axial length of the lash adjuster and to suppress wear at the contact portion with the valve stem. An engaging hole is formed in an arm pivoted by the rotation of a cam at a position corresponding to the top end face of a valve stem. A lash adjuster received in the engaging hole includes a nut member, an adjuster screw in threaded engagement with the nut member, an elastic body biasing the adjuster screw toward the valve stem, and a ball joint to reduce the axial length of the lash adjuster. Further, by bringing the bottom end face of the ball joint into surface contact with the top end face of the valve stem, wear at the contact portion is suppressed.

4 Claims, 3 Drawing Sheets

ARM TYPE VALVE GEAR

BACKGROUND OF THE INVENTION

This invention relates to an arm type valve gear used with an internal combustion engine.

Among arm type valve gears adapted to open and close an intake valve or an exhaust valve (hereinafter merely referred to as a valve) by rotating a cam, there are swing arm type valve gears, in which a camshaft is provided under a pivotally supported arm and the arm is pushed down by a cam mounted on the camshaft to open the valve, and rocker arm type valve gears, in which a camshaft is provided over an arm, and one end of the arm is pushed up to open a valve with the other end of the arm.

In these arm type valve gears, a valve clearance is automatically adjusted by mounting a lash adjuster.

As lash adjusters to be mounted in arm type valve gears, there are known hydraulic lash adjusters as described in JP patent publication 10-231711 and mechanical lash adjusters as described in JP utility model publication 5-21602.

In the hydraulic lash adjuster described in the former patent publication, since engine oil is used as hydraulic oil, there are the following problems.

① Since engine oil is stirred by a crankshaft, bubbles tend to mix into the oil. If oil in which bubbles are mixed is supplied into a pressure chamber of the lash adjuster, the lash adjuster compresses bubbles when the valve is opened, so that the lift amount of the valve changes.

② The amount of air dissolved in the engine oil increases with a change in temperature and pressure while the engine is running, so that air separates from the oil and accumulates in the pressure chamber due to cooling after the engine has stopped. This also causes the lift amount of the valve to change.

③ A reservoir chamber is needed to maintain the function of the lash adjuster until oil pressure is ensured at the restart of the engine, so that the lash adjuster tends to be large and heavy.

④ In order to introduce hydraulic oil into the lash adjuster, it is necessary to form a small-diameter oil supply passage in the arm, which is extremely difficult to form.

On the other hand, a mechanical lash adjuster does not have the problems encountered in hydraulic lash adjusters, and mechanical lash adjusters are extremely advantageous. But since female threads with which a male thread member is brought into engagement are formed on the inner periphery of a tubular lifter body having a bottom, it is necessary to provide a relief for a tool at the closed end of the lifter body in tapping the female threads. This increases the axial length of the lifter body and thus increases the size of the lash adjuster.

Further, since the valve stem is pushed down by the pivoting of the arm, it is necessary to form a spherical surface at the closed end of the lifter body and bring it into point contact with the top end face of the valve stem. Thus, the surface pressure between the lifter body and the valve stem is high, so that wear tends to develop at the contact portion.

An object of this invention is to provide an arm type valve gear in which a mechanical lash adjuster is mounted between an arm and a valve stem, and in which the lash adjuster is compact in its axial length and light in weight, and wherein wear at the contact portion with the valve stem is suppressed.

SUMMARY OF THE INVENTION

According to this invention, there is provided an arm type valve gear wherein an engaging hole is formed in an arm pivoted by the rotation of a cam at its end on the pivoting side to push down a valve stem through a lash adjuster mounted in the engaging hole, wherein the lash adjuster comprises a nut member received in the engaging hole, an adjuster screw having male threads on the outer periphery thereof that are in threaded engagement with female threads formed on the inner periphery of the nut member, an elastic body for biasing the adjuster screw toward the valve stem, a ball joint having its upper portion joined to the nut member so as not to rotate relative to it, while supporting the bottom end of the adjuster screw, and having its bottom end face in surface contact with the top end face of the valve stem, and that the female threads of the nut member and the male threads of the adjuster screw are serration-shaped such that pressure flanks which bear axial push-in force applied from the valve stem to the adjuster screw have a greater flank angle than clearance flanks.

As described above, by mounting the ball joint between the adjuster screw and the valve stem, when push-in force acts between the adjuster screw and the valve stem, the bottom end face of the ball joint slides in surface contact with the top end face of the valve stem. The sliding absorbs a component of the push-in force in a direction perpendicular to the adjuster screw.

Thus, between the adjuster screw and the valve stem, only axial loads act, so that it is possible to smoothly move the adjuster screw and the valve stem in the axial direction. It is thus possible to smoothly operate the lash adjuster.

By bringing the bottom end face of the ball joint and the top end face of the valve stem into surface contact with each other, it is possible to reduce the surface pressure at the contact portion and suppress wear at the contact portion.

Further, since the lash adjuster is of such a structure that the adjuster screw is in threaded engagement with the nut member received in the engaging hole, compared with the arrangement in which the adjuster screw is brought into threaded engagement with female threads formed on the inner periphery of the engaging hole, it is possible to reduce the axial length and and the weight.

In the arm type valve gear according to this invention, the ball joint may comprise a disk-shaped spacer mounted in a cylindrical portion provided at a lower portion of the nut member and supported so as not to be rotatable but axially movable, a spherical holder having its outer peripheral portion in engagement with the cylindrical portion to prevent the spacer from falling, a pusher held by the holder so as to be bendable and having its bottom end face in surface contact with the top end face of the valve stem, and a ball mounted between the pusher and the spacer, and wherein recessed spherical seats in which part of the ball is received are formed on the bottom surface of the spacer and the top surface of the pusher.

In this ball joint, by using, as the ball, a ball for a ball bearing, which is easily available and high in accuracy, it is possible to reduce the cost.

Here, the engaging hole may be a stepped hole, a spring washer in the shape of a stepped tube which is inserted in the engaging hole may be pressed onto the outer periphery of an upper portion of the nut member, and an elastic body comprising a coil spring may be mounted between an end plate provided at an upper portion of the spring washer and having a hole and the top end face of the adjuster screw to ensure space for mounting a coil spring that is long in the axial length on the adjuster screw. Thus, it is possible to mount a coil spring which is large in the spring constant and long in length. Further, since the spring seat can be easily formed by press molding, compared with the arrangement in which a spring receiving hole is drilled in the top end face of the adjuster screw, it is possible to reduce the cost.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
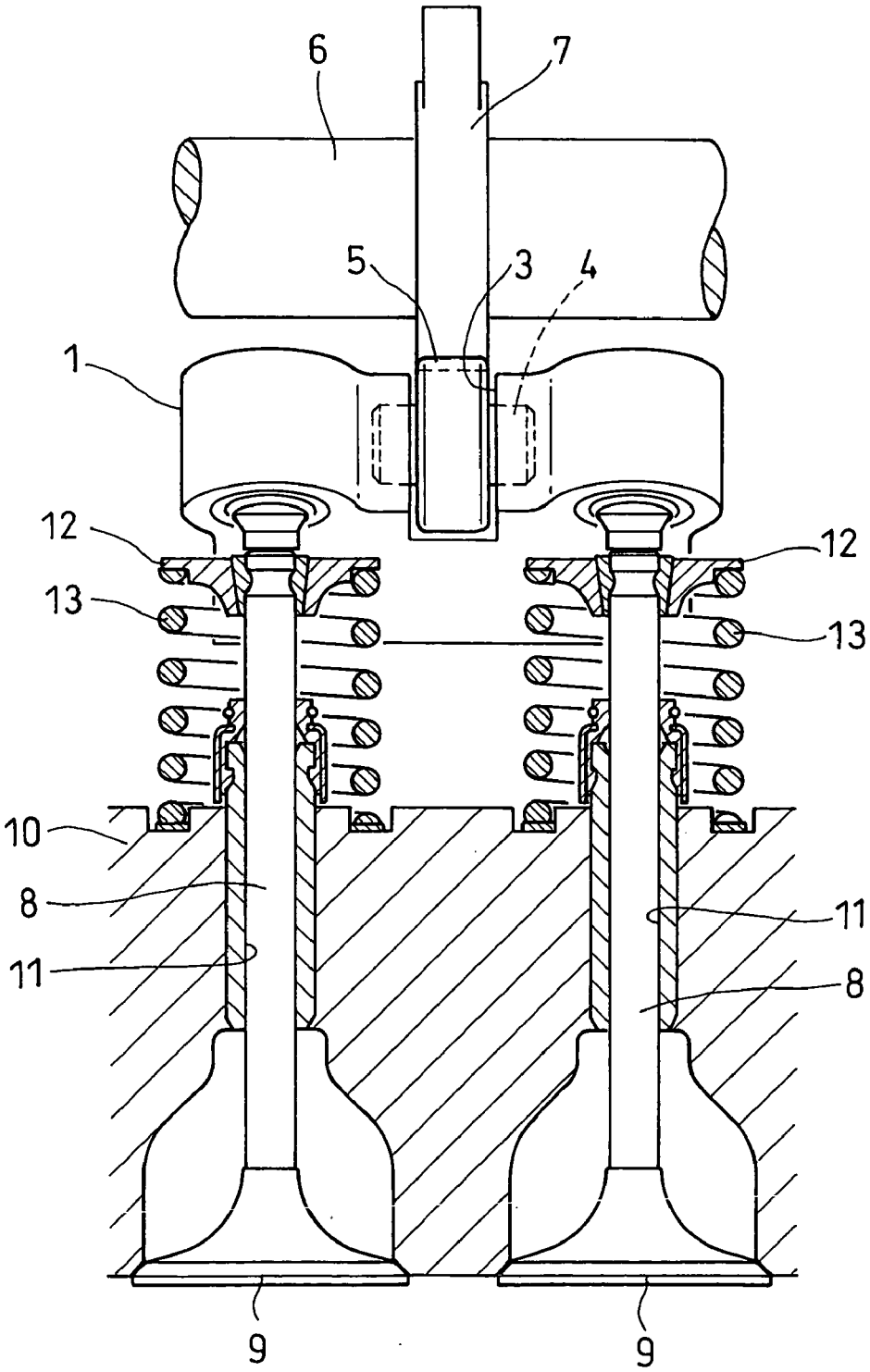
FIG. 1 is a vertical sectional front view of an embodiment of an arm type valve gear according to this invention.

Below, the embodiment of this invention will be described with reference to the drawings. FIG. 1 shows a swing arm type valve gear adapted to simultaneously open and close two valves. The swing arm 1 is supported so as to be pivotable about a support shaft 2 shown in FIG. 2. A swing arm 1 has a cutout portion 3 formed at its pivoting end. A roller 5 is rotatably supported by a roller pin 4 having its both ends supported by both side walls of the cutout portion 3.

Figure 3:
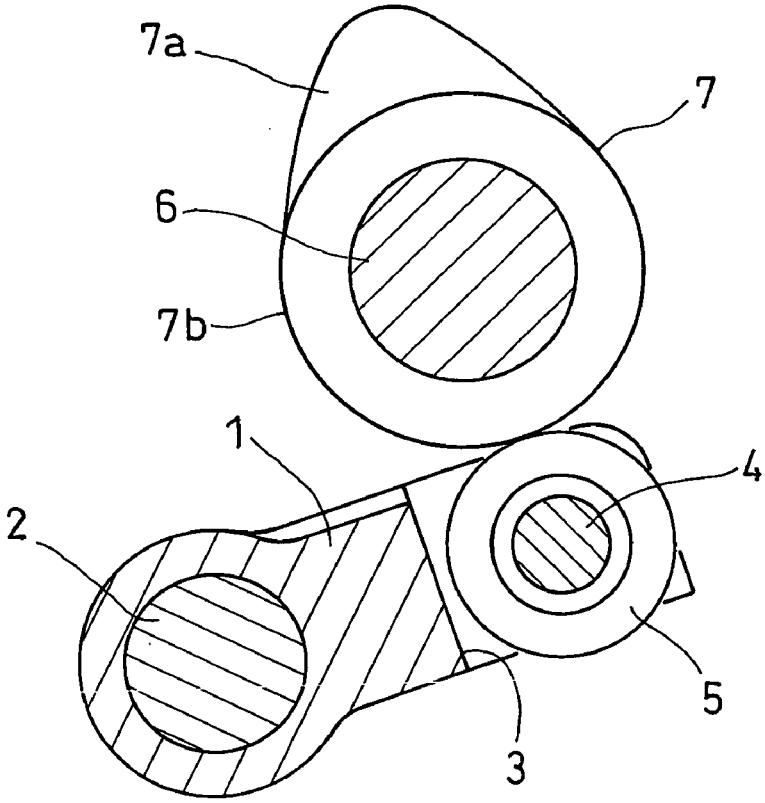
FIG. 3 is a vertical sectional side view of the swing arm shown in FIG. 1 at a contact portion between a cam and a roller.

As shown in FIGS. 1 and 3, over the pivoting end of the swing arm 1, a camshaft 6 is arranged. When the roller 5 is pushed down by the rotation of a cam 7 mounted on the camshaft 6, the swing arm 1 pivots downward. During pivoting, the two valve stems 8 are simultaneously pushed down to open the valves 9.

Each of the two valve stems 8 is slidably inserted in a guide hole 11 formed in the cylinder head 10. Each valve stem 8 has a spring retainer 12 at its top end, and the valve stems 8 are biased by valve springs 13 in such a direction that the valves 9 close.

Figure 2:
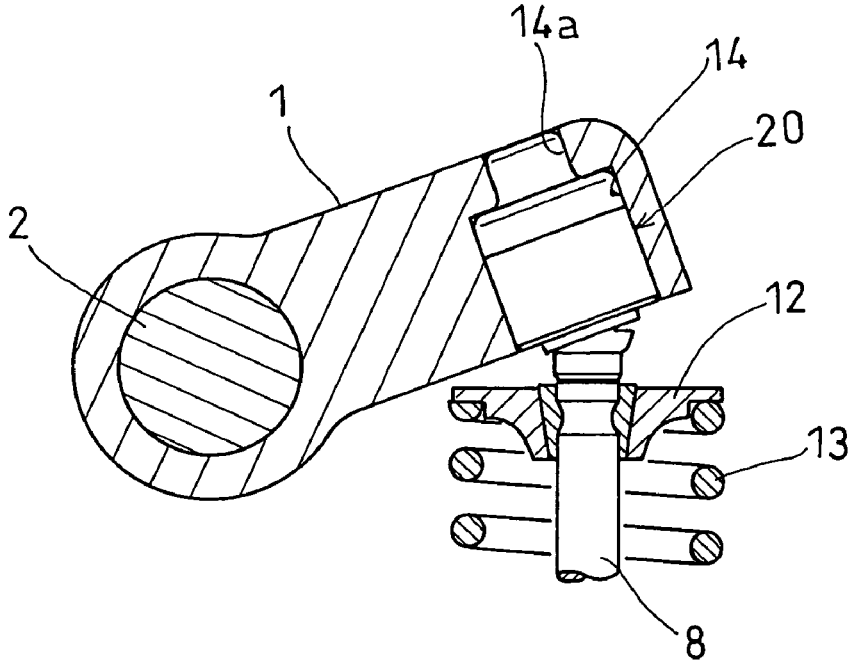
FIG. 2 is a vertical sectional side view of a swing arm shown in FIG. 1.
Figure 4:
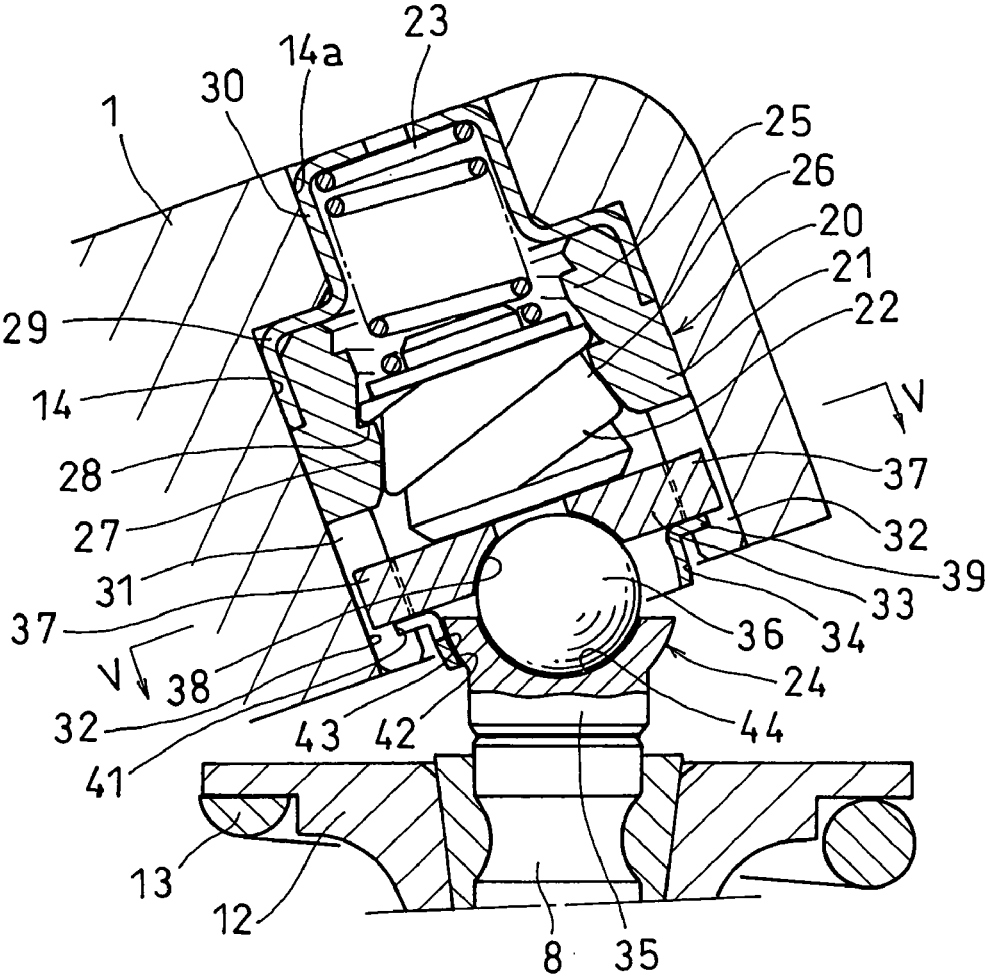
FIG. 4 is an enlarged sectional view of a portion where a lash adjuster shown in FIG. 2 is mounted.

As shown in FIGS. 2 and 4, in the swing arm 1, engaging holes 14 are formed at positions corresponding to the top ends of the respective valve stems 8. The engaging holes 14 are stepped holes. In each engaging hole 14, a lash adjuster 20 is mounted.

The lash adjusters 20 each comprise a nut member 21 received in the engaging hole 14, an adjuster screw 22 in threaded engagement with the nut member 21, an elastic body 23 biasing the adjuster screw 22 toward the valve stem 8, and a ball joint 24 mounted between the bottom end of the adjuster screw 22 and the top end of the valve stem 8.

The nut members 21 are formed by plasticizing. Female threads 25 formed on the inner periphery thereof are in threaded engagement with male threads 26 formed on the outer periphery of the adjuster screw 22.

The female threads 25 of the nut member 21 and the male threads 26 of the adjuster screws 22 are serration-shaped so that the pressure flanks 27, which receive axial push-in load applied to the adjuster screw 22 from the valve stem 8, are greater in flank angle than the clearance flanks 28. The serration-shaped threads have such a lead angle that due to pressing of the elastic body 23, the adjuster screw 22 moves axially rotating.

A spring washer 29 is pressed on the outer periphery of the nut member 21 at its top. The elastic body 23, which is a coil spring, is mounted between an end plate having a hole and provided on the top of the spring washer 29 and the top end of the adjuster screw 22. In order to ensure the mounting space for the elastic body 23, the spring washer 29 is in the shape of a stepped tube having a small-diameter tubular portion 30 which is inserted in a small-diameter hole portion 14*a* of the engaging hole 14.

Figure 5:
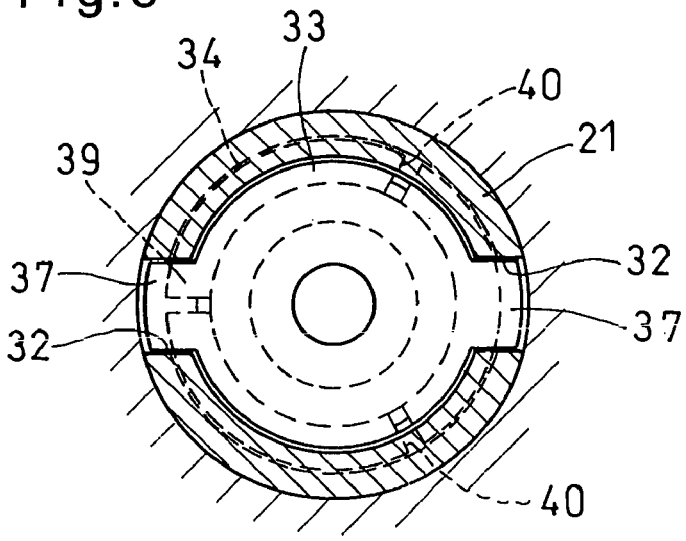
FIG. 5 is a sectional view along line V—V of FIG. 4.

As shown in FIGS. 4 and 5, a cylindrical portion 31 is integrally provided on the bottom of each nut member 21. At opposite positions of the cylindrical portion 31, cutouts 32 extending in the axial direction from the bottom end face are formed.

The ball joints 24 each comprise a spacer 33, a holder 34, a pusher 35 and a ball 36.

The spacer 33 is mounted in the cylindrical portion 31 of the nut member 21 to support the bottom end of the adjuster screw 22. The spacer 33 is disk-shaped and protrusions 37 are provided on its outer periphery at opposed positions. The protrusions 37 are slidably received in the cutouts 32 formed in the cylindrical portion 31.

The spacer 33 is prevented from turning due to the engagement of the protrusions 37 in the cutouts 32, and is movable in the axial direction. Further, on the bottom end face of the spacer 33, a recessed spherical seat 38 is formed in which part of the ball 36 is received.

The holder 34 is spherical with its top and bottom ends open. On the top large-diameter end thereof, an outward flange 39 is provided. A plurality of slits 40 are radially formed in the flange 39.

The holder 34 is mounted to the nut member 21 by engaging its flange 39 in an annular groove 41 formed in the inner periphery of the cylindrical portion 31, thus keeping the spacer 33 from coming out.

The pusher 35 has a spherical outer surface 43 in contact with and guided by the spherical inner surface 42 of the holder 34, on its outer periphery at its upper portion. The pusher 35 is held by the spherical inner surface 42 so as not to fall with its flat bottom surface kept in contact with the top surface of the valve stem 8.

A recessed spherical seat 44 is formed on the top surface of the pusher 35. The ball 36 is mounted between the spherical seat 44 and the spherical seat 38 on the bottom surface of the spacer 33.

The arm type valve gear shown in the embodiment has the above structure. When the camshaft 6 rotates and the roller 5 is pushed down by a protrusion 7*a* of the cam 7, the swing arm 1 pivots downward, so that the two valve stems 8 are pushed down simultaneously through the lash adjusters 20, so that the valves 9 open.

When the cam 7 rotates and a base circle 7*b* contacts the roller 5, due to the elasticity of the valve springs 13, the valve stems 8 will rise, so that the valves 9 close.

During such opening or closing of the valves 9, oblique push-in force is imparted to the ball joint 24 shown in FIG. 4. At this time, the spacer 33 and the pusher 35 incline relative to each other, guided by the ball 36, so that the bottom end of the pusher 35 moves in a radial direction of the valve stem 8, guided by the top end face of the valve stem 8.

Thus, the component of the oblique push-in force applied to the ball joint 24 in a direction perpendicular to the adjuster screw 22 is absorbed by the movement of the pusher 35 in a radial direction.

Thus, when the valves 9 are open, only axial loads act on the valve stems 8, so that the valve stems 8 will move smoothly in the axial direction. When the valves 9 close, axial loads act on the adjuster screws 22, and are borne by the pressure flanks 27, which are in abutment with each other.

When a valve clearance tends to develop between the top end face of each valve stem 8 and the bottom end face of the corresponding adjuster screw 22 due to thermal expansion of e.g. the cylinder head 10 resulting from temperature rise of the internal combustion engine, due to pressure of the elastic member 23, the adjuster screw 22 will move in the axial direction, rotating along the clearance flanks 28 to absorb the valve clearance.

Conversely, when the distance between the top end faces of the valve stem 8 and the camshaft 6 shortens due to wear of the valve seats in contact with the valves 9, the adjuster screws 22 are gradually pushed in due to variable loads in the axial direction applied from the valve stems 8, and retract. Due to the retraction, during closing of the valves, when the base circle 7*b* of the cam 7 contacts the roller 5, the valves 9 are kept in close contact with the valve seats, preventing compression leakage from occurring.

When push-in force is applied from each valve stem 8 to the corresponding adjuster screw 22 through the ball joint 24, since the pusher 35 moves in a radial direction, kept in surface contact with the top end face of the valve stem 8, only axial loads act on the adjuster screw 22 as in the above case. Thus, the adjuster screw 22 will smoothly move in the axial direction while rotating, so that it operates reliably.

In the embodiment, description has been made with a swing arm type valve gear as an example, but the arm type valve gear is not limited thereto. For example, it may be a rocker arm type valve gear. In the case of a rocker arm type valve gear, engaging holes are formed at the stem pressing side of the rocker arm and lash adjusters are mounted in these engaging holes.

As described above, in this invention, since the ball joints are mounted between the adjuster screws and the valve stems, it is possible to apply only axial loads to the valve stems and the adjuster screws. Thus, it is possible to smoothly move the valve stems in the axial direction when the valves are opened or closed by the pivoting of the arm, and to smoothly move the adjuster screws in the axial direction while rotating them. Thus, the lash adjusters operate reliably.

Since the contact between the ball joints and the valve stems is surface contact, surface pressure at the contact portions is small, so that it is possible to suppress wear of the contact portions.

Further, the lash adjusters are of such a structure that the nut members are received in the engaging holes and the ball joints are mounted between the respective adjuster screws and the valve stems, so that they have a small number of parts and are simple. Thus, it is possible to make the lash adjusters short in axial length and light in weight, so that it is possible to reduce the cost.

Further, since the engaging holes are stepped holes and the spring seats in the shape of stepped tubes to be inserted in the engaging holes are pressed onto the respective nut members, it is possible to provide a spring receiving space that is long in the axial length between the end place having a hole at the upper portion of each spring seat and the top end of the corresponding adjuster screw. Thus, as the elastic body for biasing each adjuster screw, it is possible to employ a coil spring that is long in the axial length and has a large spring constant. Also, compared with the arrangement in which the spring receiving space is provided by forming a spring receiving hole in the top surface of each adjuster screw, manufacturing cost can be reduced.

What is claimed is:

1. An arm type valve gear wherein an engaging hole is formed in an arm pivoted by the rotation of a cam at its end on the pivoting side to push down a valve stem through a lash adjuster mounted in the engaging hole, wherein said lash adjuster comprises a nut member received in said engaging hole, an adjuster screw having male threads on the outer periphery thereof that are in threaded engagement with female threads formed on the inner periphery of said nut member, an elastic body for biasing said adjuster screw toward said valve stem, a ball joint having its upper portion joined to said nut member so as not to rotate relative to said nut member, while supporting the bottom end of said adjuster screw, and said ball joint having its bottom end face in surface contact with the top end face of said valve stem, and wherein the female threads of said nut member and the male threads of said adjuster screw are serration-shaped such that pressure flanks which bear axial push-in force applied from said valve stem to said adjuster screw have a greater flank angle than clearance flanks.

2. An arm type valve gear as claimed in claim 1 wherein said ball joint comprises a disk-shaped spacer mounted in a cylindrical portion provided at a lower portion of said nut member and supported so as not to be rotatable but axially movable, a spherical holder having its outer peripheral portion in engagement with said cylindrical portion to prevent said spacer from falling, a pusher held by said holder so as to be bendable and having its bottom end face in surface contact with the top end face of said valve stem, and a ball mounted between said pusher and said spacer, and wherein recessed spherical seats in which part of said ball is received are formed on the bottom surface of said spacer and the top surface of said pusher.

3. An arm type valve gear as claimed in claim 1 wherein said engaging hole is a stepped hole, a spring washer in the shape of a stepped tube which is inserted in said engaging hole is pressed onto the outer periphery of an upper portion of said nut member, and an elastic body comprising a coil spring is mounted between an end plate provided at an upper portion of said spring washer and having a hole and the top end face of said adjuster screw.

4. An arm type valve gear as claimed in claim 2 wherein said engaging hole is a stepped hole, a spring washer in the shape of a stepped tube which is inserted in said engaging hole is pressed onto the outer periphery of an upper portion of said nut member, and an elastic body comprising a coil spring is mounted between an end plate provided at an upper portion of said spring washer and having a hole and the top end face of said adjuster screw.

* * * * *